United States Patent [19]

Dahlin

[11] 3,953,945

[45] May 4, 1976

[54] GRINDING MACHINE WITH ENERGY ABSORBING BREAKAGE GUARD

[75] Inventor: Richard A. Dahlin, Holden, Mass.

[73] Assignee: The Warner & Swasey Company, Cleveland, Ohio

[22] Filed: June 27, 1975

[21] Appl. No.: 590,956

[52] U.S. Cl. ..... 51/269

[51] Int. Cl.[2] ..... B24B 55/04

[58] Field of Search ..... 51/262 R, 269, 270, 51/272

[56] References Cited

UNITED STATES PATENTS

| | | | |
|---|---|---|---|
| 3,452,489 | 7/1969 | Kallander | 51/269 |
| 3,526,998 | 9/1970 | Backer et al. | 51/269 |
| 3,638,364 | 2/1972 | Grove et al. | 51/269 |
| 3,657,846 | 4/1972 | Hnilicka | 51/269 |
| 3,902,286 | 9/1975 | Matson | 51/269 |

*Primary Examiner*—Al Lawrence Smith
*Assistant Examiner*—Nicholas P. Godici

[57] ABSTRACT

An improved grinding machine includes an energy absorbing device which harmlessly dissipates the energy released in the event of a failure of a grinding wheel during a grinding operation. The energy absorbing device includes a plurality of cutters which are mounted on a common actuator plate. In the event of a breaking up of the grinding wheel, the fragments of the grinding wheel inpact against the actuator plate and move the cutters to cut away metal from blocks mounted on the base of the machine. As the metal is cut away, energy is dissipated and the kinetic energy in the fragments of the grinding wheel is harmlessly absorbed.

10 Claims, 4 Drawing Figures

GRINDING MACHINE WITH ENERGY ABSORBING BREAKAGE GUARD

BACKGROUND OF THE INVENTION

The present invention is directed to a grinding machine and more specifically to a grinding machine having a new and improved device to harmlessly absorb the kinetic energy which results upon breaking of a high speed grinding wheel into a plurality of fragments.

A known grinding machine having a device to absorb the kinetic energy which is released in the event of the failure of a grinding wheel is disclosed in U.S. Pat. No. 3,690,074. The energy absorbing device disclosed in this patent includes a plurality of layers of a resiliently compressible energy absorbing material. To compensate for local distortions which tend to occur due to concentrated loads, the various layers of energy absorbing material are separated by steel plates. This known energy absorbing device has been generally satisfactory in its mode of operation. However, the cost of making this known energy absorbing device has increased substantially due to the fact that the cost of the energy absorbing material has increased.

SUMMARY OF THE PRESENT INVENTION

The present invention provides a new and improved energy absorbing device which is relatively inexpensive to fabricate and is advantageously utilized in association with a grinding machine to absorb the kinetic energy which is released in the event of a failure of a grinding wheel. The energy absorbing device includes one or more cutters which are moved to cut one or more bodies of material and thereby dissipate the kinetic energy imparted to the fragments of the grinding wheel. The cutters are advantageously mounted on an actuator plate which is disposed adjacent to the radially outer surface of the grinding wheel. Upon a failure of the grinding wheel, the fragments of the grinding wheel impact against the actuator plate and move the cutters relative to a body of material. During this movement, a portion of the body of material is cut away with a resulting dissipation of energy. The energy absorbing device is relatively inexpensive to fabricate since the cutters and bodies of material may be formed of readily available metals which are easily shaped to the desired configuration.

Accordingly, it is an object of the invention to provide a grinding machine having a new and improved energy absorbing device which dissipates the kinetic energy resulting from a failure of a grinding wheel by performing a cutting operation.

Another object of this invention is to provide a new and improved grinding machine having an energy absorbing device which absorbs the kinetic energy released upon failure of a grinding wheel and wherein the energy absorbing device includes a cutter and metal body which are moved relative to each other under the influence of force applied to the energy absorbing device by fragments of the grinding wheel to thereby effect a cutting of the metal body and an absorbing of energy.

BRIEF DESCRIPTION OF THE DRAWINGS

From the foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
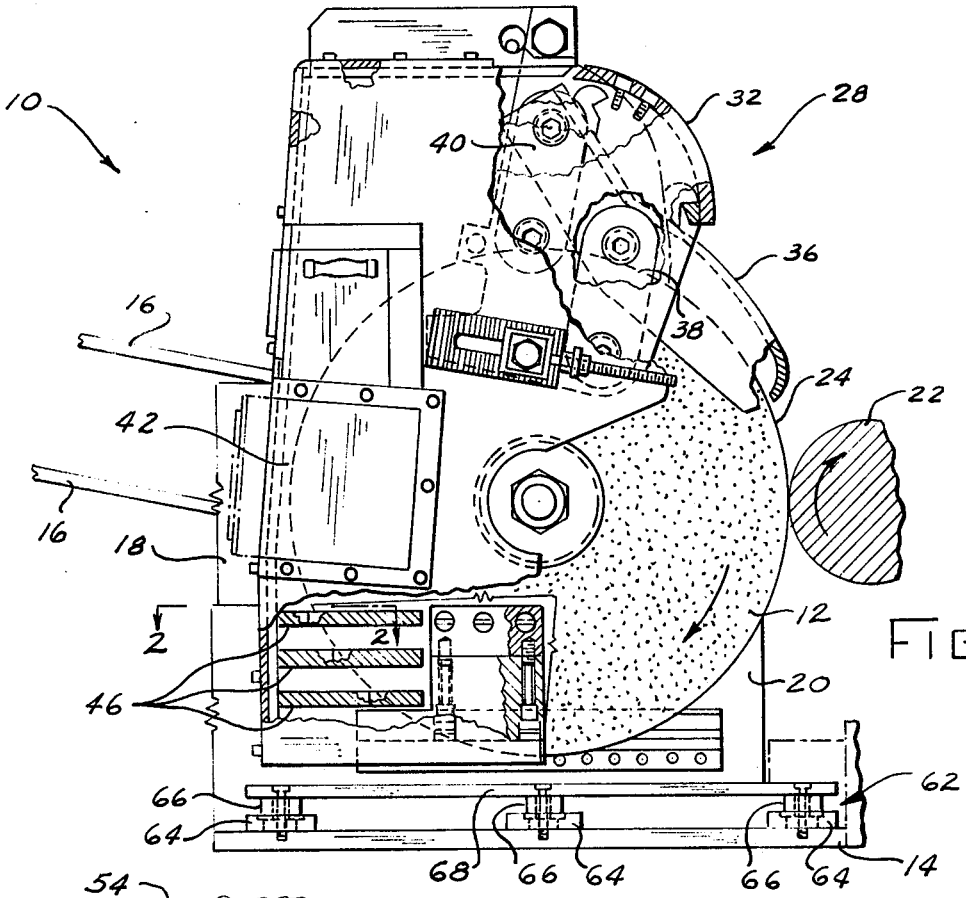
FIG. 1 is a side elevational view illustrating the relationship between the wheel of a grinding machine and an energy absorbing device constructed in accordance with the present invention.

A grinding machine 10 includes a grinding wheel 12 which is rotated in a counterclockwise direction (as viewed in FIG. 1) relative to a base 14 of the grinding machine by a drive belt 16. The grinding wheel 12 is rotatably supported upon a wheel slide 18 having a base 20 which is movable toward and away from the axis of rotation of a workpiece 22. During a grinding operation, a circular peripheral surface 24 of the rotating grinding wheel 12 engages the rotating outer surface of the workpiece 22 to grind the workpiece to a desired size in a known manner.

A grinding wheel guard assembly 28 includes an adjustable hood 32 which, in the event of a failure of the grinding wheel 15 during a grinding operation, is effective to deflect fragments of the grinding wheel downwardly in the manner disclosed in U.S. Pat. No. 3,526,998. The guard assembly 28 also includes a movable shutter 36. Two pairs of links 38 and 40 support the shutter 36 for movement from the retracted position shown in FIG. 1 to an extended position between the grinding wheel and workpiece upon failure of the grinding wheel 12. The manner in which the shutter 36 moves relative to the hood 32 is the same as is disclosed in U.S. Pat. No. 3,452,489.

Figure 2:
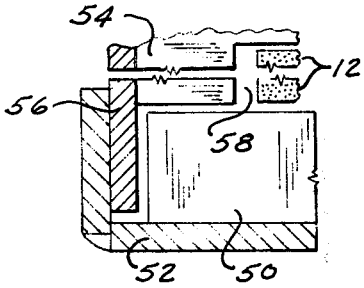
FIG. 2 ia a plan view, taken generally along the line 2—2 of FIG. 1, illustrating the relationship between the grinding wheel and a plurality of reinforcing ribs.

A grinding wheel dressing tool is disposed within a housing 42 and is protected by a plurality of rib assemblies 46. In the event of a failure or breaking up of the grinding wheel 12 during a grinding operation, the rib assemblies 46 break up the larger wheel fragments and entrap the smaller fragments. Each of the rib assemblies 46 has a generally U-shaped configuration and includes a first or side rib 50 (see FIG. 2) which is fixedly mounted on a side wall 52. A second, generally L-shaped rib 54 is mounted on a second side wall 56 of the grinding wheel guard assembly 28 and cooperates with the rib 50 to form a slot 58 into which the grinding wheel 12 extends. The construction of the rib assemblies 46 is the same as is disclosed in U.S. Pat. No. 3,690,074.

In accordance with a feature of the present invention, an improved energy absorbing device 62 is utilized to absorb the kinetic energy released in the event of a breaking up of the grinding wheel 12 into a plurality of fragments during a grinding operation. The energy absorbing device 62 includes a plurality of metal bodies or blocks 64 (see FIG. 3) which are fixedly mounted on the base 14. A plurality of spaced apart cutting tools 66 are disposed in engagement with the metal blocks 64 and are fixedly connected with a bottom side of a steel actuator plate 68.

In the event of a failure of the grinding wheel 12 for some unforeseen reason during a high speed grinding operation, the grinding wheel will break up into a plurality of fragments. Some of these fragments will be hurled downwardly toward the energy absorbing device 62 under the influence of centrifugal force. Other fragments will be hurled downwardly against the energy absorbing device 62 by the hood 32 and shutter 36. Upon impacting of the fragments against a rectangular upper major side surface 70 of the actuator plate 68 which is disposed immediately beneath the grinding wheel 12, the plate will effect relative movement between the cutting tools 66 and the metal blocks 64. This relative movement causes the cutting tools 66 to cut the metal blocks 64 with a resulting dissipation of the kinetic energy transmitted to the actuator plate 68 from the fragments of the grinding wheel 12. It should be noted that since metallic cutting tools 66 are utilized to cut away metal from the metallic blocks 64, the energy absorbing device 62 can be constructed of relatively inexpensive materials.

Each of the metal blocks 64 has a generally rectangular configuration and is provided with a plurality of cylindrical openings 72. Each of the cylindrical openings 72 is associated with one of the cutting tools 66. Each of the cutting tools 66 abuts a major side surface 73 of the plate 68 and has a cylindrical outer surface 74 of a diameter which is slightly greater than the diameter of the cylindrical openings 72. The rectangular plate 68 has a length and width such that the entire grinding wheel is disposed directly above the plate during movement of the grinding wheel into and out of engagement with the workpiece.

Upon impacting of fragments of the grinding wheel 12 against the actuator plate 68, the cylindrical cutting tools 66 are forced axially downwardly into the somewhat small cylindrical openings 72 in the blocks 64. As each one of the cutting tools 66 moves into an associated block 64, circular leading end faces 78 of the cutting tools 66 cut away portions of the metal blocks 64 to increase the diameter of the openings 72 with a punching action. Thus, as the cutting tool 66 moves axially downwardly into the opening 72 from the position illustrated in solid lines in FIG. 4 to the position shown in dashed lines, a thin cylindrical portion of the side wall 82 is cut away to form a circular chip indicated in dashed lines at 86 in FIG. 4.

In this manner the kinetic energy of the grinding wheel fragments impacting and the actuator plate 68 is utilized to perform a punching type cutting operation in which portions of the block 64 are harmlessly cut away. At the end of the cutting operation, the cutting tools 66 are disposed in a telescopic relationship with the enlarged openings 72 in the blocks 64. The downward movement of the cutting tools 66 into the blocks 64 is guided by rods 86 which are connected with the base 14 andd are disposed in a coaxial relationship with the associated cutting tool 66 and the opening 72.

Figure 3:
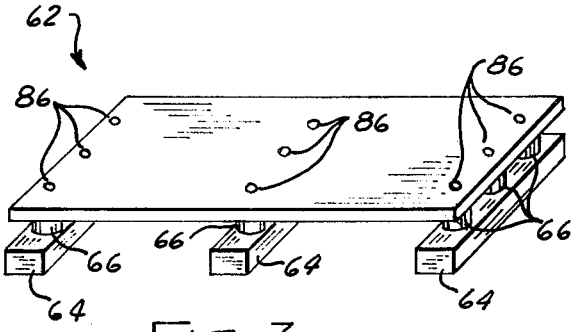
FIG. 3 is a pictorial illustration of the energy absorbing device, the various other components of the grinding machine being omitted for purposes of clarity of illustration.
Figure 4:
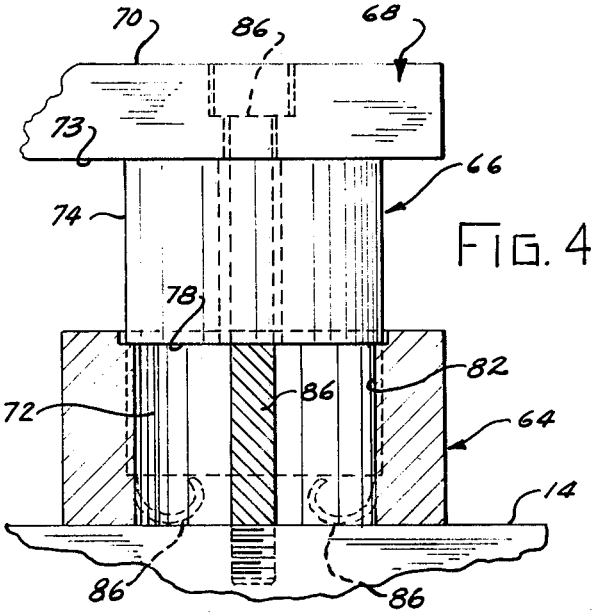
FIG. 4 is an enlarged fragmentary sectional view illustrating the relationship between a cutting tool, a body of metal and an actuator plate of the energy absorbing device of FIG. 3.

It should be understood that although a single cutting tool 66 and opening 72 have been illustrated at FIG. 4, a plurality of cylindrical openings are formed in the block 64 in association with the cutting tools 66 (see FIG. 3). Although in the illustrated embodiment of the invention the cutting tools 66 are moved by the actuator plate 68 relative to the blocks 64, this motion could be reversed. Thus, the blocks 64 could be mounted on the actuator plate 68 and the cutting tools 66 mounted on the base 14 in such a manner that the blocks 64 are moved relative to the cutting tools to effect the cutting operation upon impacting of fragments of the grinding wheel 12 against the actuator plate 68. Although the cutting tools 66 have been described herein as having a cylindrical configuration and being associated with cylindrical opening 72, it is contemplated that they could have a different configuration. In fact, it is contemplated that rather than the plurality of cutting tools 66 could be replaced by a single relatively large cutting tool in association with a single block of metal.

In view of the foregoing description, it is apparent that a grinding machine 10 constructed in accordance with the present invention includes an energy absorbing device 62 for harmlessly absorbing the kinetic energy resulting from a breaking up of the grinding wheel 12. To accomplish this, the impact absorbing device 62 includes a cutting tool 66 which is moved upon impacting of fragments of the grinding wheel against the actuator plate 68. Movement of the cutting tool 66 cuts away a portion of the block 64 to thereby harmlessly absorb the kinetic energy in the fragments of the grinding wheel 12 by performing a cutting operation.

Having described one specific preferred embodiment of the invention, the following is claimed:

1. A grinding machine comprising a base, a rotatable grinding wheel connected with said base and having a generally circular peripheral surface which engages a workpiece during a grinding operation, means for rotating said grinding wheel at a relatively high speed relative to said base during a grinding operation, and energy absorbing means disposed adjacent to said grinding wheel for absorbing energy released in the event of breaking of said grinding wheel into a plurality of fragments during a grinding operation, said energy absorbing means including a body of material, cutter means for cutting away a portion of said body of material, and actuator means for effecting relative movement between said body of material and said cutter means under the influence of forces applied to said actuator means by fragments of said grinding wheel to effect a cutting away of a portion of the body of material and an absorbing of energy.

2. A grinding machine as set forth in claim 1 wherein said body of material includes first and second spaced apart end portions, said cutter means and body of material being relatively movable at least part way along a path extending between said first and second end portions of said body of material under the influence of said actuator means to cut away a portion of said body of material.

3. A grinding machine as set forth in claim 1 further including a plurality of bodies of material in addition to the aforementioned body of material, said cutter means including a plurality of spaced apart cutting elements, said cutting elements and bodies of material being movable relative to each other by said actuator means to simultaneously cut away portions of each of said bodies of material.

4. A grinding machine as set forth in claim 1 wherein said actuator means includes a plate member having a major side surface facing toward said generally circular peripheral surface of said grinding wheel, said plate member being movable toward said base under the influence of impact forces applied to said plate member by fragments of said grinding wheel to effect relative movement between said body of material and said cutter means.

5. A grinding machine as set forth in claim 4 wherein said plate member has first and second opposite edge portions which are spaced apart by a distance which is greater than the diameter of the circular peripheral surface of said grinding wheel and third and fourth opposite edge portions which are spaced apart by a distance which is greater than the axial thickness of said grinding wheel.

6. A grinding machine as set forth in claim 1 wherein said body of material includes surface means for defining an opening having a first cross sectional area, said cutter means including a cutter body having a second cross sectional area which is larger than said first cross sectional area, said actuator means being operable to cause said cutter body to increase the cross sectional area of at least a portion of said opening in said body of material from said first cross sectional area to said second cross sectional area upon relative movement between said body of material and said cutter means.

7. A grinding machine as set forth in claim 1 wherein said cutter means and said body of material move into a telescopic relationship with said cutter means at least partially disposed within said body of material upon relative movement between said cutter means and said body of material.

8. A grinding machine comprising a base, a rotatable grinding wheel connected with said base, means for rotating said grinding wheel at a relatively high speed, a set of spaced apart cutter bodies, a set of spaced apart cuttable bodies associated with said cutter bodies, means for connecting a first one of said sets of bodies with said base, and actuator means for moving the second one of said sets of bodies relative to said first set of bodies under the influence of forces applied to said actuator means by fragments of said grinding wheel in the event of breaking of said grinding wheel, each of said cutter bodies including means for cutting away a portion of the cuttable body upon movement of the second set of bodies relative to the first set of bodies.

9. A grinding machine as set forth in claim 8 wherein said actuator means includes a plate member having a first major side surface facing toward said grinding wheel and a second major side surface disposed in engagement with said second set of bodies, said first major side surface of said plate member being engageable by fragments of said grinding wheel to effect movement of said plate member toward said base under the influence of impact forces applied against said plate member by fragments of said grinding wheel.

10. A grinding machine as set forth in claim 8 wherein said cuttable bodies include surface means for defining a plurality of openings each of which is associated with one of said cutter bodies, each of said cutter bodies including means for increasing the size of the associated one of said openings in said cuttable bodies upon relative movement therebetween.

* * * * *